United States Patent [19]

Mazzanti

[11] Patent Number: 4,945,812

[45] Date of Patent: Aug. 7, 1990

[54] MUZZLE BRAKE AND METHOD OF MAKING THE SAME

[76] Inventor: Vincent E. Mazzanti, 6114 Terryhill Dr., La Jolla, Calif. 92037

[21] Appl. No.: 179,037

[22] Filed: Apr. 7, 1988

[51] Int. Cl.[5] ..... F41C 21/18

[52] U.S. Cl. ..... 89/14.3

[58] Field of Search ..... 89/14.2, 14.3, 14.4; 42/1.06

[56] References Cited

U.S. PATENT DOCUMENTS

| | | | |
|---|---|---|---|
| 2,212,686 | 8/1940 | Hughes | 89/14.3 |
| 2,362,996 | 11/1944 | Green | 89/14.3 |
| 3,115,060 | 12/1963 | Ashbrook et al. | 89/14.3 |
| 3,202,056 | 8/1965 | Seeberger | 89/14.3 |
| 4,545,285 | 10/1985 | McLain | 89/14.3 |

FOREIGN PATENT DOCUMENTS

| | | | |
|---|---|---|---|
| 825614 | 3/1938 | France | 89/14.3 |

*Primary Examiner*—Charles T. Jordan
*Assistant Examiner*—Michael J. Carone
*Attorney, Agent, or Firm*—Charles C. Logan, II

[57] ABSTRACT

A muzzle brake for a firearm is formed from an elongated tubular sleeve that has a plurality of circular rows of apertures drilled from its outer surface to its inner bore. The circumferential spacing between each of the apertures in each row being such that they intersect the adjacent appertures on both sides of them at a point intermediate the wall thickness to produce integrally formed baffles in the interior of the tubular sleeve. The baffles function to reduce the recoil of the firearm and further to aid in directing the propellant gases of a bullet radially outwradly through the radial apertures of the muzzle brake.

12 Claims, 1 Drawing Sheet

MUZZLE BRAKE AND METHOD OF MAKING THE SAME

BACKGROUND OF THE INVENTION

The invention relates to firearms and more specifically to a muzzle brake that can be either integrally formed on the end of a gun barrel or formed as a separate member that would be attachable thereto.

In the past muzzle brakes of various designs have been known. They serve the purpose of keeping the recoil energy of the guntube, developed during firing, low, and thereby reducing the recoil braking force on the gun. This is achieved by forcing the propellant gases, flowing out at the muzzle, to strike against baffles of a muzzle brake. The gases are diverted to the rear as much as possible and generate a forward force on the muzzle brake, which retards the backward recoil of the barrel.

Muzzle brakes having various patterns of apertures and slits are presently available commercially. Many of these have complicated structures that are costly to manufacture. Others are of a simple configuration but are not felt to be very efficient.

It is an object of the invention to provide a novel method of making a high efficiency muzzle brake at an economical cost.

It is an object of the invention to provide a method of forming a muzzle brake in the integrally formed barrel of a firearm.

It is another object of the invention to provide a novel muzzle brake that operates at a high efficiency rate.

SUMMARY OF THE INVENTION

Applicant's novel muzzle brake and the method of making the same has been designed to be economical to manufacture. Of equal importance is the fact that it performs at a high efficiency rate.

The muzzle brake is formed by taking a tubular sleeve having an outside diameter D2 and inside diameter D1 and a wall thickness T and drilling a plurality of circular rows of apertures in the tubular sleeve. The axes of these apertures are substantially perpendicular to the outer surface of the tubular sleeve. The circumferential spacing between each of these apertures is such that they intersect the adjacent apertures on both sides of them at a point intermediate the wall thickness T to produce integrally formed baffles in the interior of the tubular sleeve. The apertures of each of the rows intersect each other at a point between twenty percent to sixty percent of the thickness of the wall of the tubular sleeve. If the intersection of the apertures is at a point spaced radially outwardly from the bore of the tubular sleeve greater than sixty percent of the wall thickness, the muzzle brake would not have sufficient structural integrity to perform its function over a normal lifetime. If the intersection of the apertures is at a point less than twenty percent spaced from the interior diameter of the tubular sleeve, the internally formed baffle would not provide a sufficient amount of wall height to appreciably intersect the propellant gases as they are traveling through the bore of the muzzle brake. The efficiency of such a muzzle brake would be quite low since their purpose is to reduce the recoil of a firearm and also to aid in directing propellant gases of the bullet radially outwardly through the radial apertures of the muzzle brake. In order to insure the high performance of applicant's novel muzzle brake, the apertures of each circular row are radially spaced from each other in the range of twenty degrees to sixty degrees. The diameter of the apertures should be in the range of twenty percent to thirty percent of the outside diameter of the tubular sleeve. The longitudinal spacing of the axes of adjacent circular rows of apertures should be in the range of 1.25–2.0 times the diameters of the apertures.

Due to the structure of applicant's novel muzzle brake, it is possible to form the muzzle brake integrally on the barrel of a firearm or it may be formed as a separate component that would be screw threaded thereon.

DESCRIPTION OF THE PREFERRED EMBODIMENT

Figure 1:
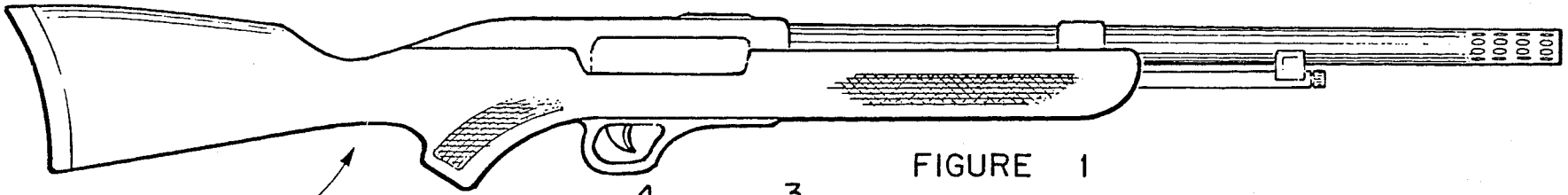
FIG. 1 is a side elevation view illustrating applicant's novel muzzle brake formed integrally on the barrel of a rifle.

Applicant's novel muzzle brake will now be described by referring to FIGS. 1–5 of the drawing.

In FIG. 1 the muzzle brake 10 is illustrated as being formed integrally on the front end of gun barrel 12 of the rifle 14.

Figure 2:
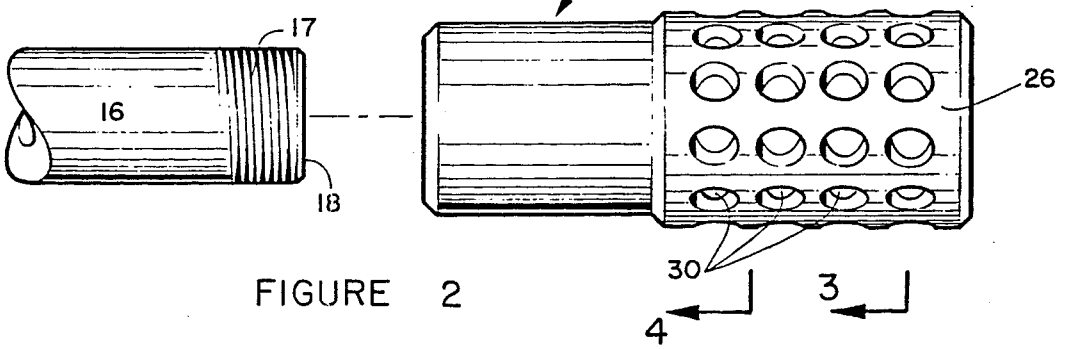
FIG. 2 is a side elevation view of the muzzle brake formed as a separate component which would be screw threaded on the end of a gun barrel.
Figure 3:
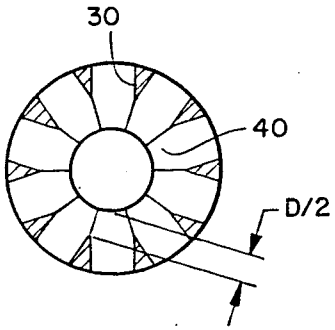
FIG. 3 is a cross sectional view taken along lines 3—3 of FIG. 2.
Figure 4:
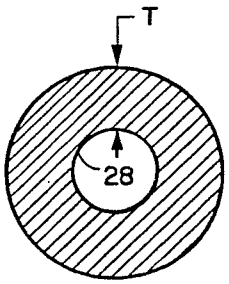
FIG. 4 is a front end elevation view of the muzzle brake illustrated in FIG. 2.
Figure 5:
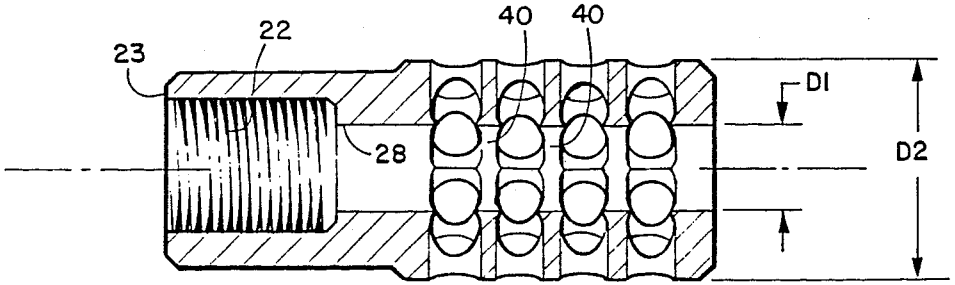
FIG. 5 is a crosssectional elevation view of the novel muzzle brake.

In FIG. 2, a gun barrel 16 is illustrated having external threads 17 formed on its front end 18. A muzzle brake 20 has internal threads 22 formed on its rear end 23. The muzzle brake 20 is formed of a tubular sleeve 26 having a bore 28 having a bore D2. The outer diameter of tubular sleeve 26 is D2 and the wall thickness is T. A plurality of rows of apertures 30 are spaced radially around the circumference of tubular sleeve 26. The cross sectional view illustrated in FIG. 3 shows this disclosed embodiment of the muzzle break having the apertures 30 intersect at a point T/2 distance from the inner diameter D1 of the tubular sleeve. The plurality of rows of apertures 30 thus form a plurality of baffles 40 with chambers formed between the adjacent baffles. The tubular sleeve is preferably less than three inches long.

What is claimed is:

1. A muzzle brake comprising:

an elongated tubular sleeve having a front and end and a rear end and being of a predetermined length that is less than three inches long;

said tubular sleeve having a bore through which a bullet will pass having an internal diameter D1 and an external diameter D2 that forms a wall thickness T, said internal diameter being only slightly larger than that of the bullet that will pass therethrough; and a plurality of rows of circular apertures formed in said tubular sleeve, the circumferential spacing between each of these apertures in the same circular row being such that they intersect the adjacent apertures on both sides of them at a point intermediate the internal diameter D1 and the external diameter D2 to produce at least one integrally formed baffle in the bore of the tubular sleeve between each circular row of apertures, said baffles functioning to reduce recoil of a firearm to which the muzzle brake would be attached and further to aid in directing the propellant gases of a bullet radially outwardly through the apertures through the muzzle brake.

2. A muzzle brake comprising:

an elongated tubular sleeve having a front end and a rear end and being of a predetermined length;

said tubular sleeve having a bore through which a bullet will pass having an internal diameter D1 and an external diameter D2 that forms a wall thickness T, said internal diameter being only slightly larger than that of the bullet that will pass therethrough; and a plurality of rows of circular apertures formed in said tubular sleeve, the circumferential spacing between each of these apertures in the same circular row being such that they intersect the adjacent apertures on both sides of them at a point D2 to produce at least atone integrally formed baffle in the bore of the tubular sleeve between each circular row of apertures, the apertures of each row of apertures intersect each other at a point within the wall of said muzzle brake between twenty percent to sixty percent of its thickness, said baffles functioning to reduce recoil of a firearm to which the muzzle brake would be attached and further to aid in directing the propellant gases of a bullet radially outwardly through the radial apertures of the muzzle brake.

3. A muzzle brake as recited in claim 2 wherein said tubular sleeve is integrally formed on the front end of a gun barrel.

4. A muzzle brake as recited in claim 2 where in the rear end of said tubular sleeve has an internally threaded counterbore for attaching said muzzle brake to the externally threaded front end of the barrel of a firearm.

5. A muzzle brake as recited in claim 2 wherein there are at least three circular rows of apertures in said tubular sleeve to form a plurality of internal baffles therein that form propellant gas expansion chambers between adjacent baffles.

6. A muzzle brake as recited in claim 2 wherein the axes of the apertures of each circular row are radially spaced from each other in the range of twenty degrees to sixty degrees.

7. A muzzle brake as recited in claim 2 wherein the diameter of said apertures should be in the range of twenty percent to thirty percent of the outside diameter of said tubular sleeve.

8. A muzzle brake comprising:

an elongated tubular sleeve having a front end and a rear end and being of a predetermined length;

said a tubular sleeve having a bore through which a bullet will pass having an internal diameter D1 and external diameter D2 that forms a wall thickness T, said internal diameter being only slightly larger than that of the bullet that will pass therethrough; and a plurality of rows of circular apertures formed in said tubular sleeve, the circumferential spacing between each of these apertures in the same circular row being such that they intersect the adjacent apertures on both sides of them at a point intermediate the internal diameter D1 and the external diameter D2 to produce at least one integrally formed baffle in the bore of the tubular sleeve between each circular row of apertures, the longitudinal spacing of the axes of adjacent circular rows of apertures should be in the range of 1.25–2.0 times the diameter of said apertures, said baffles functioning to reduce recoil of a firearm to which the muzzle brake would be attached and to further aid in directing the propellant gases of a bullet radially outwardly through the radial apertures of the muzzle brake.

9. A method of making a muzzle brake for a firearm comprising:

(a) taking a tubular sleeve having an outside diameter D2 and an inside diameter D1 and a wall thickness T and drilling a plurality of circular rows of apertures in said tubular sleeve, the circumferential spacing between each of these apertures being such that they intersect the adjacent apertures on both sides of them at a point intermediate the wall thickness T to produce integrally formed baffles in the interior of said tubular sleeve, the apertures of each row of apertures intersecting each other at a point within the wall of said muzzle brake between twenty percent to sixty percent of its thickness, said baffles function being to reduce the recoil of a firearm to which the muzzle brake would be attached and further to aid in directing the propellant gases of a bullet radially outwardly through the radial apertures of the muzzle brake.

10. A method of making a muzzle brake for a firearm as recited in claim 9 wherein said tubular sleeve forms the integral front end of the gun barrel of a firearm.

11. A method of making a muzzle brake for a firearm as recited in claim 9 wherein the apertures of each circular row are radially spaced from each other in the range of twenty degrees to sixty degrees.

12. A method of making a muzzle brake for a firearm as recited in claim 9 wherein the diameter of said apertures should be in the range of twenty percent to thirty percent of the outside diameter of said tubular sleeve.

* * * * *